United States Patent [19]

Rekewitz

[11] 4,195,940

[45] Apr. 1, 1980

[54] LINE CONTROL FOR PLATEN PRINTING DEVICES

[75] Inventor: Rudolf Rekewitz, Weidach, Fed. Rep. of Germany

[73] Assignee: Siemens Aktiengesellschaft, Berlin & Munich, Fed. Rep. of Germany

[21] Appl. No.: 815,216

[22] Filed: Jul. 13, 1977

[30] Foreign Application Priority Data

Jul. 26, 1976 [DE] Fed. Rep. of Germany ..... 2633498

[51] Int. Cl.[2] ..... B41J 19/76

[52] U.S. Cl. ..... 400/568; 400/551; 400/616.3; 400/902; 400/567

[58] Field of Search ..... 400/551, 567, 568, 569, 400/616.1, 616.3, 902; 74/405; 318/254, 685; 307/293; 361/196

[56] References Cited

U.S. PATENT DOCUMENTS

| | | | |
|---|---|---|---|
| 3,458,772 | 7/1969 | Egart et al. | 361/196 |
| 3,461,322 | 8/1969 | Hirsch et al. | 307/293 |
| 3,618,738 | 11/1971 | Boyatt et al. | 400/551 |
| 3,644,812 | 2/1972 | Bitto et al. | 318/254 |
| 3,694,725 | 9/1972 | Abraham et al. | 318/685 |
| 3,754,631 | 8/1973 | Wang et al. | 400/568 X |
| 3,872,959 | 3/1975 | Wang et al. | 400/568 X |
| 3,880,016 | 4/1975 | Jamieson et al. | 74/405 |
| 3,902,584 | 9/1975 | Lee et al. | 400/568 |

OTHER PUBLICATIONS

IBM Technical Disclosure Bulletin, "Adapter for Half-Line Space Control", Heath, vol. 19, No. 5, Oct. 1976, pp. 1539–1541.

*Primary Examiner*—Ernest T. Wright, Jr.
*Attorney, Agent, or Firm*—Hill, Van Santen, Steadman, Chiara & Simpson

[57] ABSTRACT

A control for platen rotation in printers, and particularly in telex machines where the platen rotation drive, either a stepping motor or a DC motor, is provided with an incremental control actuated by keyboard keys to advance or counter advance the platen by a small increment of the full line space whereby alignment of the imprinting line with form spaces is facilitated.

1 Claim, 1 Drawing Figure

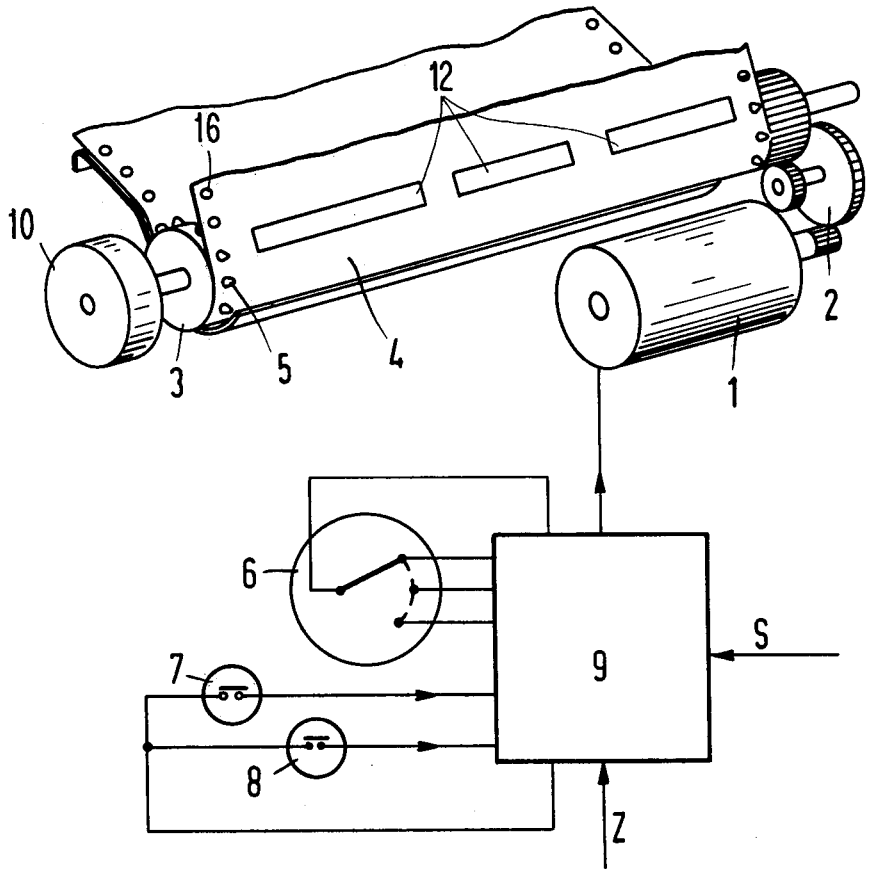
12
16
10
3
5
4
2
1
6
7
8
9
S
Z

LINE CONTROL FOR PLATEN PRINTING DEVICES

BACKGROUND OF THE INVENTION

1. Field of the Invention

This invention relates to writing devices and more particularly to platen rotation controls for writing devices.

2. Prior Art

Standard writing devices such as telex machines, typewriters and the like utilize a paper feed system including a rotatable roller which functions as a platen. Rotation of the platen is controlled, in modern machines, either by a stepping motor or a direct geared DC motor. Normal line spacing is predetermined, although it is common to provide selectivity to advance the platen either by a normal line space, two line spaces or three line spaces for each designated line advance. Normal line advance, once the multiple is selected, is automatic and is normally geared to an input indicating when a new line is to be printed. When writing on preprinted forms it is necessary for the operator to make sure, after insertion of a new form sheet, that the line imprinting will occur such that the characters are aligned with the middle of the transverse column of block forms or on a preprinted line. In the case of mechanisms using mechanical line advance systems, those systems normally engage at intervals of one half of the normal line space. Transverse alignment errors outside of the half space division are normally corrected by changing the relative position of the drive engagement system and a spike wheel controlling paper movement.

However, when a stepping motor or the like drive system is used, even after switching off the motor, or when turning the platen by hand to create original alignment, the system can thereafter stop in a position which no longer coincides with the transverse column of the preprinted form. This misalignment can again be corrected by adjusting the relative settings of the drive and the spike wheel even though thereafter the stepping motor or DC drive is relied upon for normal line advance.

In order to make these adjustments, access to the platen wheel area is required so that the relative positioning between the spike wheel and the drive system can be changed. In addition, this manual rearranging of line position may be required relatively frequently. It would be an improvement in the art to avoid the necessity of the prior art manual alignment requirements.

SUMMARY OF THE INVENTION

The primary object of this invention is to position the first set of transverse columns of a stack of forms upon initial insertion of the paper such that the characters printed by the machine lie in the middle of the transverse column or, when preprinted forms using lines are used, lie on the line. This object is to be met without necessitating any variable connection between the spike paper drive roller and the line advance drive as has been common with the prior art mechanical spike roller drive systems. The "fine adjustment" of the line positioning is to be carried out by the platen drive which consists of a stepping or DC motor used to control line advance.

The above object is achieved in accordance with this invention in that the control system for the motor includes switching means which can be activated by first and second keys on the keyboard of the printing device. When the first key is depressed, the line advance motor advances one step clockwise and when the second key is depressed the motor advances one step counterclockwise. The size of each of the steps is determined either by the stepping angle of a stepping motor or by a timing circuit which fixes the duration of current flow in the case of a DC motor. The step corresponds to a fraction of the angle of rotation of the platen or spike roller needed for advance of the paper by one normal line space.

This arrangement advantageously provides for fine adjustment of the position of the typing on a form from the keyboard. The knob or wheel provided for rotation the roller is now only needed as an initial aid to paper insertion. Thus the platen control knob can be installed within the shroud or housing of the machine which reduces manufacturing expenses. Further the danger that the relationship between printing and line drive will change at fairly high printing speeds is considerably smaller than with the prior mechanical spike rollers.

It is therefore the object of this invention to provide a printing mechanism having a paper line advance actuated from a motor with the motor having an input control for actuation both in paper advance and retract modes, the input being keyboard controlled whereby fine adjustment of the position of the printing line vis-a-vis the paper can be controlled from the keyboard with the final position being retained for further normal line advance.

Other objects, features and advantages of the invention will be readily apparent from the following description of a preferred embodiment thereof, taken in conjunction with the accompanying drawing, although variations and modifications may be effected without departing from the spirit and scope of the novel concepts of the disclosure, and in which:

BRIEF DESCRIPTION OF THE DRAWING

The FIGURE is a diagrammatic perspective view of the line advance mechanism and control of this invention.

DESCRIPTION OF THE PREFERRED EMBODIMENT

The FIGURE diagrammatically and schematically illustrates an embodiment of this invention and shows a paper roll platen such as might be used in association with a telex machine. The platen has a spike roller 3 which engages paper form 4 which may, for example, have transversely spaced preprinted block areas 12 which are to be imprinted. The normal turning wheel 10 is attached to the spike roller 3 for initial in-feed of the paper form 4.

A stepping motor 1 drives the spike roller 3 through a gear system 2. The paper form 4 is placed around the spike roller 3 and is positively engaged by means of the spikes 5 indexing with corresponding perforations 16 in the paper form 4. The multiple line spacing (1, 1½ or 2 lines) is selected by properly activating the switch 6 to the desired multiple. This switch 6 together with switches or keys 8 and 7 form a part of the electronic control system 9 for the stepping motor 1. In other respects the control system 9 is similar to those presently available and will be properly chosen is association with the motor chosen. The motor 1 may be a stepping motor which, when receiving an impulse from the electronic control system 9, executes a certain predetermined rotational movement. Alternatively the motor 1 may be a DC motor which, in a given time period, will undergo a given rotational movement. Thus the control system 9 may, in association with the stepping motor 1, introduce the desired signal to the stepping motor 1 to cause it to undergo one step. Alternatively, when used in association with a DC motor, the control system 9 may introduce an input to the motor for a predetermined time period. The number of inputs to the stepping motor 1, or the time period of input is controlled by the switch 6 for normal line spacing and, for example, if the rotational angle of the stepping motor 1 is preset to be 1/6 of a normal space, and if the switch 6 is selected to have normal spacing of 1½, then the normal impulse number from the electronic control system 9 to the stepping motor 1 would be 9 impulses at the time of a normal line advance. Alternatively if a DC motor 1 were being used, and if it took 6 discrete time periods of activation to cause the DC motor 1 to rotate the roller 3 by one normal line space and if the switch 6 were set at a double space, then the control system 9 would, at normal line spacing commands, power the DC motor for 12 time periods.

The keys 7 and 8 form a part of a special keyboard section. Whenever these keys 7 or 8 are depressed the motor 1 turns one step counter-clockwise or clockwise depending upon the key depressed. The gear system 2 is preferably designed so that the motor 1 executes 6 steps, or is activated for 6 predesignated time intervals, for a single line spacing of 4.25 mm.

When the control system 9 of the motor 1 receives the command "new line" from the keyboard (lines Z) or from the receiver (lines S), the motor 1 executes the corresponding number of steps and feeds the paper form 4 over the roller 3 by an appropriate distance with the aid of the spike roller 3 of the platen. This amount is chosen to match the spacing of the preprinted paper form 4 which will normally be preprinted having spacing corresponding to the normal line advance of such machines. When inserting a new stack of paper forms 4 the operator must make sure that the printing line of the telex or typewriter being used will lie in the middle of the transverse column of the preprinted paper form 4 or will lie on the preprinted lines of the paper form 4. With this invention, the stepping motor 1 now offers the possibility of moving the platen rotation step by step until the position of the paper form 4 coincides with the type line of the writing machine. The first column or imprinted line 12 on the stack of paper forms 4 is thus reached after insertion of the paper form 4 around the platen by using the keys for single steps, 7 and 8 thereby activating the motor 1 for a fraction of its normal line rotation.

By providing both clockwise and counterclockwise or fore and back switches 7 and 8, if the middle of the preprinted column is passed, the operator can cause the paper form 4 to be moved back to the middle of the column by having the motor 1 execute single fractional rotation steps in reverse.

When the spiked platen has reached the predetermined line position, that position will thereafter form the basis for the subsequent full line advance of 1, 1½ or 2 times the 4.25 mm spacing.

Since the setting of the position of the paper form 4 is now controlled by using the keys 7 and 8 of the special section of the keyboard, and therefore moving the motor 1 one fractional full line rotational step at a time, it will be seen that proper positioning of the paper is simplified and, can be accomplished by the operator without access to the interior of the machine or the platen wheel. This is particularly advantageous in connection with shrouded typing machines such as telex machines where, in order to keep noise to an acceptable level, the operating portions of the machine are encased in a sound confining housing.

By utilizing a full line advance at 4.25 mm and by dividing that spacing into six subspaces or subrotational degrees, paper advance or retract will be only 0.71 mm per subspace. This means that the alignment error between the printed form 4 and the typing line of the writer will be only 0.35 mm. The error of course will be correspondingly greater or smaller by using other ratios between the individual steps or rotation of the motor 1 and the normal line spacing. Since the fractional line spacing is controlled by the keys 7 and 8 while the normal line spacing mutiple is chosen by the switch 6, the control system 9 will be set such that normal line advance will always be the multiple step chosen by the switch 6. In this manner, the switches 7 and 8 establish a base position of the form 4 on the roller and thereafter all normal line advance will be the multiple chosen by the switch 6 from the form position chosen by the keys 7 and 8.

It can therefore be seen from the above that this invention provides a control for paper advance in a writing machine which utilizes keyboard located switches to advance or back the paper on the platen by a predetermined fractional amount of the normal line spacing whereby the platen may be fractionally rotated either in an advance or a retract direction to properly position paper forms received around the platen with respect to the line imprint position of the writing machine whereby the line imprint position can be aligned with preprinted paper lines or transversely spaced columns with all fine positioning being provided at the keyboard.

Those skilled in the art will readily appreciate that the control system 9 may include circuits selected from a multitude of satisfactory timing circuits, usually resistance-capacitance (RC) circuits. For those not particularly versed in the electronics art, reference may be taken to U.S. Pat. No. 3,458,772 for a discussion of a circuit for controlling the motor 1 by the provision of a d.c. signal of predetermined duration. The switch 15 takes the place of the present switch 7 (8) and the motor 1 may be electrically connected to the terminal 21*a*. Also, the motor 1 may be the load 11 (in FIG. 3) in U.S. Pat. No. 3,461,322, with the switch 7 (8) constituted by the switch 26.

Although the teachings of my invention have herein been discussed with reference to specific theories and embodiments, it is to be understood that these are by way of illustration only and that others may wish to utilize my invention in different designs or applications.

I claim:

1. A character writing device having a rotatable paper feed member which is rotated for line advance movement of a paper received around the feed member by a motor coupled to the feed member, the motor being activated by a control to provide a preselected rotational degree advance of the feed member for each normal line advance command, the improvement of the control for the motor including fractional advance means for activating the motor to rotate the feed member by a fractional amount of a full line spacing in both a paper advance and a paper retract direction of a rotation of the paper feed member, the fractional advance means including writing device keyboard switch means including a first key effective to cause the control to rotate the paper feed member in a paper advance direction a fractional amount of the full line spacing upon activation of the first key and a second key effective to cause the control to rotate the paper feed member a fractional amount of the normal line advance distance in a paper retract direction upon activation of the second key, the fractional advance means being independent of the normal line advance command whereby the position of the paper feed member chosen by actuation of the first and second keys will form a base rotational position for further normal line advance, the motor being a DC motor, and the fractional advance means including a time circuit controlling delivery of current to the DC motor in response to actuation of the first and second keys for a predesignated time interval, the normal line advance command causing said control to activate the time circuit for a plurality of the time intervals.

* * * * *